US011319720B2

(12) United States Patent
Udagawa

(10) Patent No.: US 11,319,720 B2
(45) Date of Patent: May 3, 2022

(54) TRANSPORTABLE BREAKROOM BOX

(71) Applicant: FUNABORI Co., Ltd., Tokyo (JP)

(72) Inventor: Masanori Udagawa, Tokyo (JP)

(73) Assignee: FUNABORI CO., LTD., Tokyo (JP)

( * ) Notice: Subject to any disclaimer, the term of this patent is extended or adjusted under 35 U.S.C. 154(b) by 0 days.

(21) Appl. No.: 17/179,410

(22) Filed: Feb. 19, 2021

(65) Prior Publication Data

US 2021/0270051 A1 Sep. 2, 2021

(30) Foreign Application Priority Data

Feb. 28, 2020 (JP) ..... JP2020-032606

(51) Int. Cl.
*E04H 3/10* (2006.01)

(52) U.S. Cl.
CPC ..... *E04H 3/10* (2013.01)

(58) Field of Classification Search
CPC .... E04H 3/00; E04H 3/10; E04H 1/12; E04H 1/1216; E04H 1/1211
See application file for complete search history.

(56) References Cited

FOREIGN PATENT DOCUMENTS

| | | | | | |
|---|---|---|---|---|---|
| CN | 207618338 | U | * | 7/2018 | |
| JP | H651407 | U | | 7/1994 | |
| JP | H786279 | B2 | | 9/1995 | |
| JP | 2001288911 | A | | 10/2001 | |
| JP | 2006241957 | A | | 9/2006 | |
| JP | 2017138081 | A | * | 8/2017 | |
| JP | 6618517 | B2 | | 12/2019 | |
| KR | 20170083471 | A | * | 7/2017 | |
| KR | 101791115 | B1 | * | 10/2017 | |
| KR | 102200404 | B1 | * | 1/2021 | |
| WO | WO-2007102798 | A1 | * | 9/2007 | ..... A61L 2/208 |

* cited by examiner

*Primary Examiner* — Babajide A Demuren
(74) *Attorney, Agent, or Firm* — Hauptman Ham, LLP

(57) ABSTRACT

A transportable breakroom box is disclosed that comprises: a box as a breakroom having a floor space equal to or less than ten square meters; a sliding door; a vaporization filter; a water storage tank that stores water to be supplied to the vaporization filter; and a water supply pump; an exhaust blower; and, one or both of a hanging hook used for hanging, the hanging hook being provided on a shingle of the box, and a floor beam to which forks of a forklift truck can be hooked, wherein, the exhaust blower sucks and discharges air in the box, and sucks outside air through the vaporization filter, and water supplied to the vaporization filter and dripped down from the vaporization filter is collected in the water storage tank.

5 Claims, 3 Drawing Sheets

TRANSPORTABLE BREAKROOM BOX

RELATED APPLICATIONS

The present application claims priority to Japanese Application Number 2020-032606, filed Feb. 28, 2020, the disclosure of which is hereby incorporated by reference herein in its entirety.

TECHNICAL FIELD

The present invention relates to a box that can be transported and moved in an assembled state, particularly a transportable breakroom box that provides a space, such as a breakroom, a smoking room, or the like.

BACKGROUND ART

In a construction site or a civil engineering site, a factory building in which a temperature becomes high due to hot air, or the like, a building for a break or a breakroom may be provided for workers so as not to take a break outside or in a high-temperature circumstance during a break.

For example, a movable box used for workers at a break in a construction site is proposed considering there has been no special building used for workers at a break in a construction site or the like, and a prefabricated simple building where materials or the like are put has been used (see PTL 1).

Further, a movable prefabricated soundproof room is proposed (see PTL 2). The movable prefabricated soundproof room is installed within a room to be used as a smoking room, a nursery, or the like.

CITATION LIST

Patent Literature

{PTL 1} Japanese Utility Patent Application Laid-Open Publication No. H06-051407Y {PTL 2} Japanese Patent Application Laid-Open Publication No. 2006-241957 A

SUMMARY OF INVENTION

Technical Problem

The movable box disclosed in PTL 1 is a container or the like to be hung by a crane. The box is equipped with a generator, a water storage tank, a sewage tank, and a propane gas cylinder.

Further, the movable prefabricated soundproof room disclosed in PTL 2 includes: a frame made of threaded pipes and the like; an air mat attached to the frame from the outside; soundproof panels fitted to the frame from the inside; and a fireproof sheet that covers the most outer part.

Incidentally, at construction sites or civil engineering in summer, work is carried out in a high temperature environment due to the rise in temperature. Further, in a manufacture site, such as a factory or the like, there is a building where a machine or a device discharges hot air is installed. People who work in such a building is in a high-temperature work circumstance.

For workers in hot environments, it is desirable to use an air-conditioned break room during breaks. Since the movable box disclosed in PTL 1 is equipped with a generator, air-conditioning equipment can be installed. However, the movable box is made to be used also in remote areas, such as a mountain village and the like, where electricity and water supply are inconvenient. The movable box is unsuitable for being installed in a building in a factory. Further, the movable prefabricated soundproof room disclosed in PTL 2 tries to secure transportability and easiness of assembling by forming the frame with threaded pipes and the like. Therefore, the soundproof room cannot be equipped with air-conditioning equipment.

Incidentally, the revised Health Promotion Act permits providing a designated smoking room indoors in facilities, such as a factory and the like, in a case where they meet the standards set by the government. In a case where the designated smoking room is provided, partition walls shall be installed in part of a building to provide a space separated from other areas. Necessary devices, such as smoke evacuation equipment and the like, are installed in the separated space. Alternatively, the designated smoking room is additionally provided outside a building. In this case, however, the designated smoking room needs to be connected to an existing wall, and new pillars need to be installed. Therefore, construction of installing the designated smoking room is a major undertaking, and needs a long construction term. Further, the designated smoking room cannot be moved after the installation. For example, in a case where the designated smoking room needs to be removed to install a new device or new equipment in the building, or the like, troublesome removal work is necessary.

Therefore, the object of the present invention is to provide a transportable breakroom box that can be moved using loading and unloading machines, such as a crane, a forklift truck, and the like. Further, an inside of the transportable breakroom box is effectively cooled with small electrical energy even if the transportable breakroom box is installed in a high-temperature circumstance.

Solution to Problem

As a technical means that achieves the above object, a transportable breakroom box according to the present invention includes: a box as a breakroom having a floor space equal to or less than ten square meters; a sliding door as an entrance provided to the box; a vaporization filter provided to an opening which is arranged in a first wall of the box; a water storage tank that is provided at an outside of the first wall, and stores water that is to be supplied to the vaporization filter; and a water supply pump that supplies water stored in the water storage tank to the vaporization filter; an exhaust blower arranged at a second wall that is opposite the first wall; and one or both of a hanging hook used for hanging, the hanging hook being provided on a shingle of the box, and a floor beam to which forks of a forklift truck can be hooked, and the exhaust blower sucks and discharges air in the box, and sucks outside air through the vaporization filter, and water supplied to the vaporization filter and dripped down from the vaporization filter is collected in the water storage tank.

That is to say, the box, the exhaust blower, and the vaporization filter function as a cool-wind fan. Therefore, heat of vaporization of water supplied to the vaporization filter is removed, cool wind is supplied into the box, and the breakroom made of the box is cooled. Due to the cool-wind fan, energy is saved. Further, a hook of a crane is hooked to the hanging hook, and the box can be hung and moved. Further, forks of a forklift truck are hooked to the floor beam, and the box is lifted to be moved. Note that one of the hanging hook and the floor beam to which forks are hooked may be provided. However, preferably, both of the hanging hook and the floor beam to which forks are hooked are provided because a form of movement that is suitable for a site can be selected.

Further, the transportable breakroom box has a floor space equal to or less than ten square meters, and is movable. Therefore, procedure provisions for confirmation application under the Building Standards Act is not necessary, and the transportable breakroom box is promptly installed at a desired location.

Further, preferably, in the above transportable breakroom box, an air conditioner is installed at the box.

In some places where the transportable breakroom box is installed, heating may be necessary in winter.

Therefore, the air conditioner is installed to heat the breakroom. Note that, a window plate that opens and closes the opening may preferably be detachably attached at the opening where the vaporization filter is installed, and the window is closed during heating.

Further, preferably, in the above transportable breakroom box, a ventilation fan is installed at the box.

The transportable breakroom box may be used as a smoking room. In that case, a smoke evacuator or an air purifier may be installed to purify air. Further, preferably, a ventilation fan that discharges odor and smoke in the room to the outside may be provided. When the ventilation fan is activated, the window at which the vaporization filter is installed is opened to promote sucking air. In this case, supply of water to the vaporization filter is stopped.

Further, preferably, in the above transportable breakroom box, the shingle is painted with thermal insulation paint.

In a case where the transportable breakroom box is installed outdoors, since the sun is shining on the shingle, the thermal insulation paint may be painted so as to decrease in a temperature in the room due to sun light, and cooling efficiency in the room is maintained.

Further, preferably, in the above transportable breakroom box, water supplied to the vaporization filter is supplied through a sterilization device.

Since water supplied to the vaporization filter is circulated between the vaporization filter and the water storage tank, the sterilization device removes various bacteria contained in the supplied water. Various bacteria are prevented from being contained in wind supplied to the room.

Advantageous Effects of Invention

The transportable breakroom box of the present invention supplies cool wind into the room and is easily installed at a desired place, therefore, installing the transportable breakroom box in a building of a factory where a temperature becomes high or outdoors allows workers to take a break in the cooled breakroom, maintain good health and be refreshed effectively.

A perspective view that schematically illustrates a transportable breakroom box according to the present invention;

FIG. 2

Figure 1:
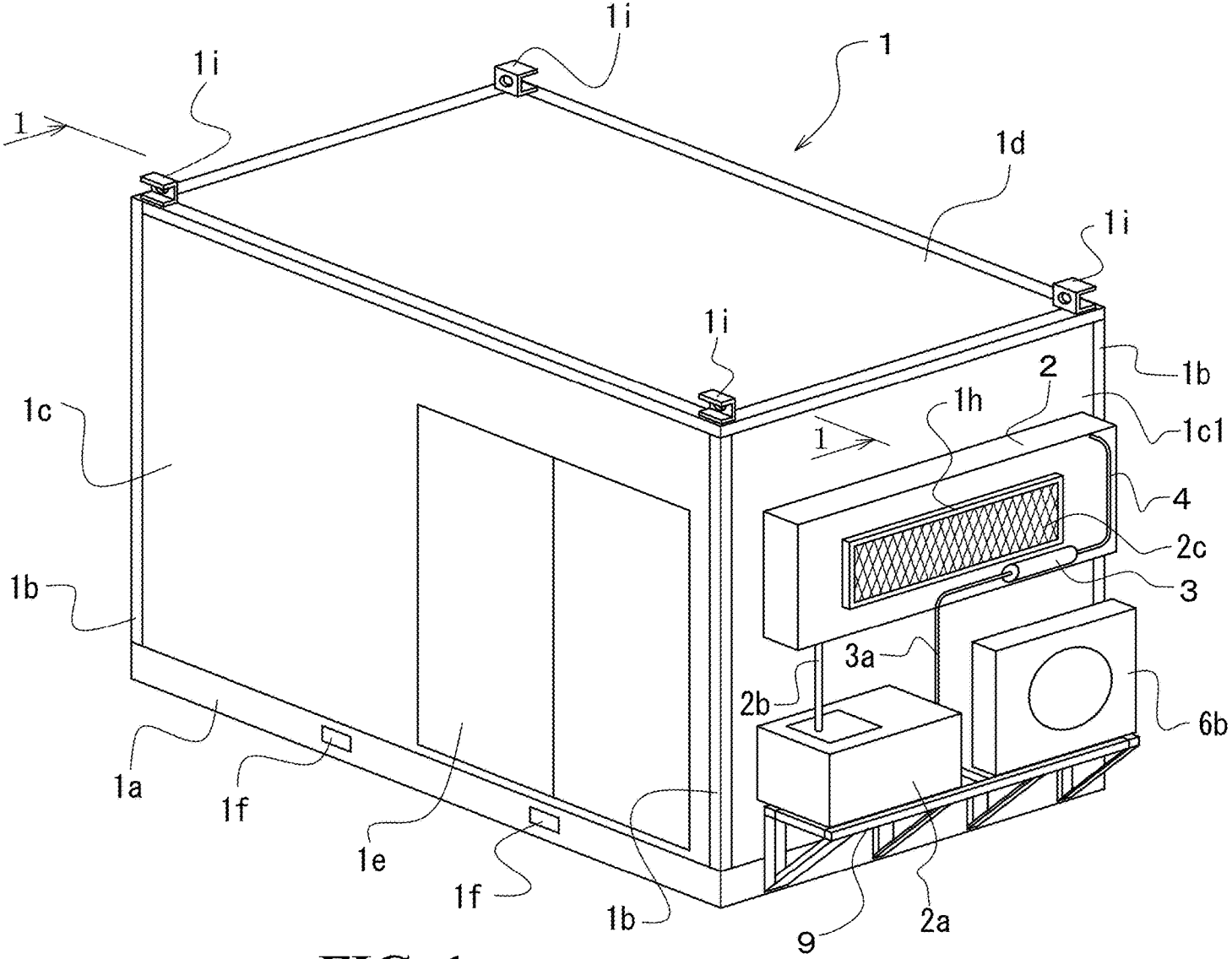
FIG. 1

A front view of the transportable breakroom box according to the present invention with partial cross-sectional view that is taken along line 1-1 in FIG. 1;

FIG. 3

Atop view of the transportable breakroom box according to the present invention;

FIG. 4

A left side view of the transportable breakroom box according to the present invention; and

FIG. 5

A right side view of the transportable breakroom box according to the present invention.

DESCRIPTION OF EMBODIMENTS

Hereinafter, a transportable breakroom box according to the present invention will be specifically described on the basis of a preferred exemplary embodiment that is illustrated.

FIG. 1 is a schematic perspective view that illustrates an appearance of a transportable breakroom box 1 according to the present invention. The transportable breakroom box 1 is shaped approximately like a cuboid. Note that pillars 1*b* are vertically provided at four corners of a rectangular combination of floor beams 1*a*. The pillars 1*b* support wallboards 1*c*. Tops of the pillars 1*b* support a shingle 1*d*. An entrance 1*e* of a sliding doorway is provided in a front one of the wallboards 1*c*. This sliding door way may be inset with transparent glass to allow visibility of the interior of the transportable breakroom, which is desirable from a lighting perspective.

When the portable breakroom box 1 is installed outdoors, its roof is exposed to direct sunlight, which increases the indoor temperature of the portable breakroom box. Therefore, by applying thermal insulation paint to the shingle 1*d*, the rise in the indoor temperature of the portable breakroom box 1 can be suppressed and the indoor cooling efficiency can be maintained.

Further, a pair of insertion holes 1*f* is formed at the center of one of the floor beams 1*a* that is disposed at a front, where an appropriate space is provided between the pair of insertion holes 1*f*. The insertion holes 1*f* are formed at positions at which a pair of forks of a forklift truck can be inserted. The insertion holes 1*f* have a size in which the forks can be inserted. Further, the pair of insertion holes 1*f* is disposed at positions that allow a load to be equally applied to a pair of forks in a case where the transportable breakroom box 1 to which necessary equipment and devices are attached, as described below, is lifted with the forks.

Figure 2:
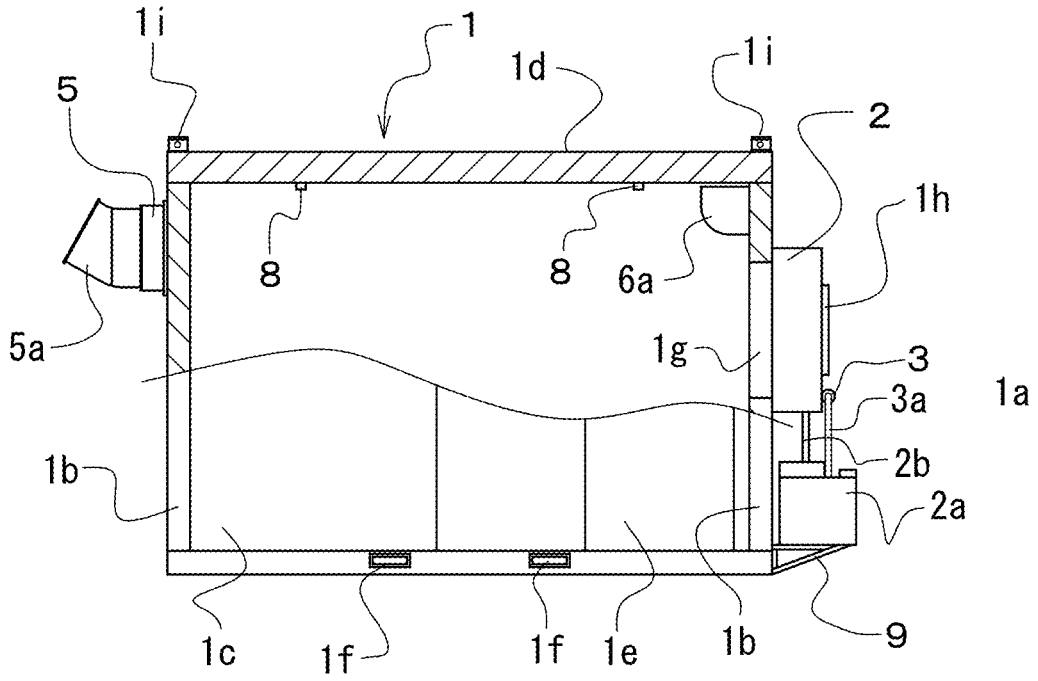

As illustrated in FIG. 2, an opening 1*g* is formed through a wallboard 1*c*1 on a right side as a first wall of the transportable breakroom box 1. A filter unit 2 having a vaporization filter 2*c* is provided on an outside of the wallboard 1*c*1 in the state of facing the opening 1*g*. Outside air is supplied into the transportable breakroom box 1 through the vaporization filter 2*c* of the filter unit 2 and the opening 1*g*. A window frame 1*h* is provided on an outside of the filter unit 2. Outside air is supplied into the transportable breakroom box 1 through the vaporization filter 2*c* of the filter unit 2 from the window frame 1*h*. A screen door may preferably be detachably attached to the window frame 1*h*, and the window plate that closes the opening 1*g* may preferably be detachably attached.

A water storage tank 2*a* for storing water is provided under the filter unit 2. A water supply pump which is not illustrated is installed within the water storage tank 2*a*. The water supply pump sucks water in the water storage tank 2*a* from a suction opening, and discharges the water from a discharge opening. An ultraviolet (UV) filter 3 as a sterilization device is provided on an outside surface of the filter unit 2. Water discharged from the water supply pump is supplied to an inlet side of the UV filter 3 through an inlet-side water supply hose 3*a*, and passes the UV filter 3.

Further, a water supply hose 4 is connected to an outlet side of the UV filter 3 to supply water to an upper portion of the vaporization filter 2*c* of the filter unit 2 through the water supply hose 4. Water supplied to the vaporization filter 2*c* flows down a filter board within the vaporization filter 2*c*. The water flowed down to the bottom portion is collected in the water storage tank 2*a* through a drain hose 2*b*.

Figure 3:
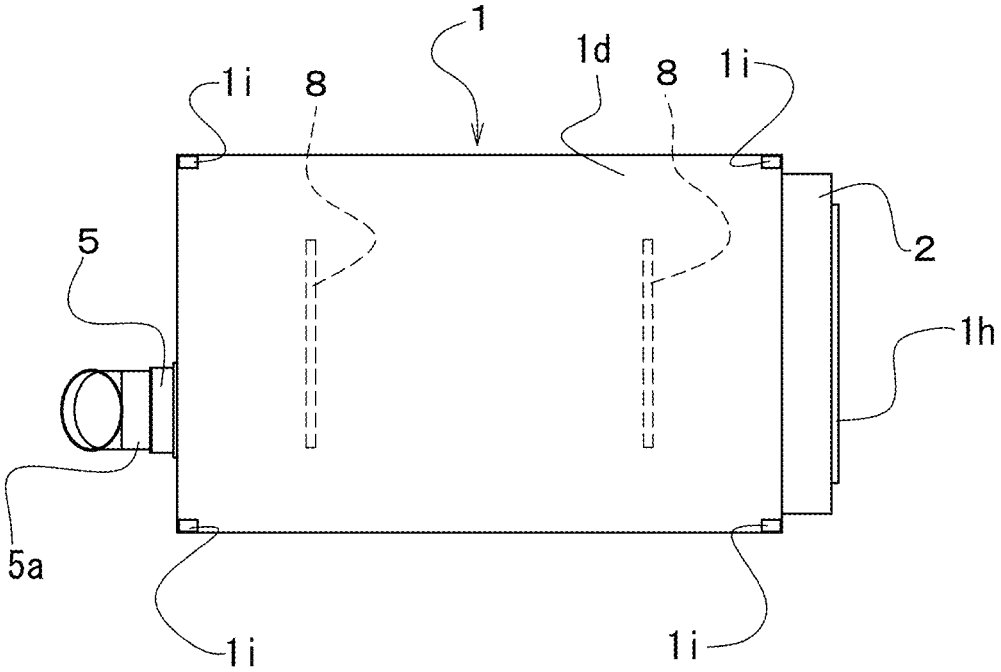
Figure 4:
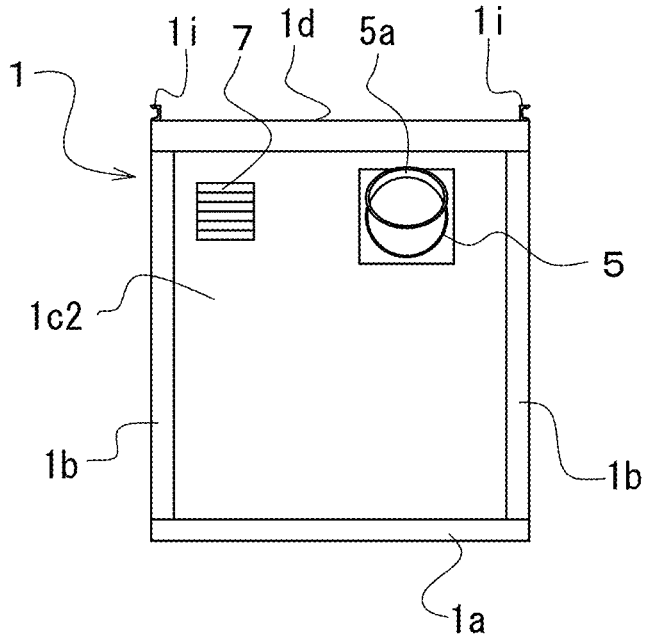
Figure 5:
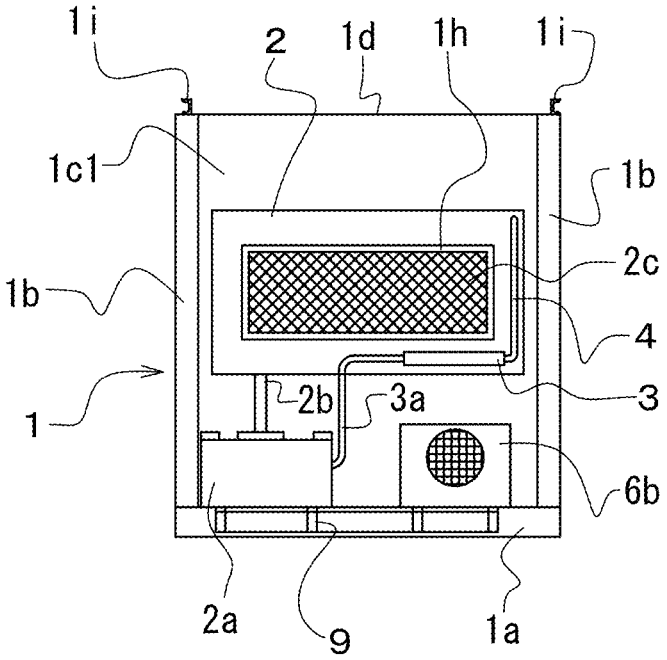

An exhaust blower 5 is provided on a wallboard 1*c*2 on a left side as a second wall that is opposite the wallboard 1*c*1, as illustrated in FIGS. 2 to 4. The exhaust blower 5 discharges air within the transportable breakroom box 1 to the outside. Note that a discharge duct 5*a* that is appropriately curved is connected to a discharge side of the exhaust blower 5 to discharge air in a direction that does not interfere the discharge.

An indoor unit 6*a* of an air conditioner is attached near a ceiling in the transportable breakroom box 1. An outdoor unit 6*b* of the air conditioner is installed next to the water storage tank 2*a*. Further, a ventilation fan 7 is installed next to the exhaust blower 5.

Note that the water storage tank 2*a* and the outdoor unit 6*b* are installed on a mounting trestle 9 attachment is attached to the wallboard 1*c*1.

Further, LED lights 8 are attached on the ceiling.

Further, rope hooks 1*i* as a hanging hook are provide at four corners of the shingle 1*d* of the transportable breakroom box 1, a rope for hooking a not illustrated hook of crane is to be threaded through the rope hook 1*i*.

Hereinafter, functions of the transportable breakroom box 1 according to the present invention configured as described above will be described.

The transportable breakroom box 1 is hung and lifted with a crane, using the rope hook 1*i* to load the transportable breakroom box 1 onto, for example, a load-carrying platform of a truck, or to unload the transportable breakroom box 1 from, for example, a load-carrying platform of a truck. Therefore, the transportable breakroom box 1 can be transported with transportation vehicles, such as trucks and the like, to a desired place. The transportable breakroom box 1 that has been transported is unloaded with a crane from a load-carrying platform of a transportation vehicle. The transportable breakroom box 1 that has been unloaded is transported with a forklift truck from a place where the transportable breakroom box 1 has been unloaded to a place where the transportable breakroom box 1 is to be used. At this time, forks of the forklift truck are inserted in the insertion holes 1*f*, and the forks are lifted to transport the transportable breakroom box 1.

Tap water is stored in the water storage tank 2*a* of the transportable breakroom box 1 that has been transported to the place where the transportable breakroom box 1 is to be used. Further, electric devices, such as the water supply pump, the exhaust blower 5, the air conditioner that includes the indoor unit 6*a* and the outdoor unit 6*b*, the lights 8, and the like, are connected to commercial power supply.

When the water supply pump and the exhaust blower 5 are activated, the exhaust blower 5 sucks an inside air of the transportable breakroom box 1, and outside air is sucked into the transportable breakroom box 1 through the vaporization filter 2*c* of the filter unit 2.

Further, the water supply pump sucks water stored in the water storage tank 2*a*, and discharges the water. After the discharged water passes the UV filter 3 and is sterilized, the sterilized water is supplied to the upper portion of the vaporization filter 2*c*. When the supplied water flows down a surface of the filter board of the vaporization filter 2*c*, and outside air that has been sucked passes the vaporization filter 2*c*, the air becomes cold air that is cooled by the filter board, which removes the vaporization heat from the falling water, and the cooled air is supplied into the transportable breakroom box 1 to be used to cool an inside of the transportable breakroom box 1. Therefore, people who are taking a break in the transportable breakroom box 1 feel the cool wind and feel coolness, and take a break effectively.

Further, in a case where an inside of the transportable breakroom box 1 does not need to be cooled, such as in winter or the like, cooled air is not supplied unless the exhaust blower 5 and the water supply pump are activated. At this time, the inside of the transportable breakroom box 1 may be heated by activating the air conditioner as necessary. Note that if a window panel or the like is attached to the window frame 1*h* to close the opening 1*g*, outside air does not enter the transportable breakroom box 1, and heating effect is more provided.

Even at a time of heating, in a case where dryness has been accelerated in the transportable breakroom box 1, the transportable breakroom box 1 can be humidified by activating the exhaust blower 5 and the water supply pump.

Further, ventilation in the transportable breakroom box 1 is accelerated by activating the ventilation fan 7.

Further, the transportable breakroom box 1 may be used as a smoking room by installing a smoke separator and an air purifier in the transportable breakroom box 1. In a case where the transportable breakroom box 1 is used as a smoking room, preferably, the ventilation fan 7 is activated to discharge the odor and smoke to the outside.

Further, the transportable breakroom box 1 can be transported by transportation vehicles, and can be moved by forklift trucks, as described above. Further, a floor space of the transportable breakroom box 1 is equal to or less than ten square meters. Since the floor space is equal to or less than ten square meters, the procedure provisions for confirmation application under Article 6 of the Building Standards Act are not applied. Further, due to the transportability, the installation location is not limited. And, the transportable breakroom box 1 is promptly installed by transporting to installation place quickly without requiring a construction period.

Further, in the description of this embodiment, the entrance 1*e* is arranged at the left side of the flowing direction of cool wind of the exhaust blower 5. However, the wallboard 1*c* on a front side and the wallboard 1*c* on a back side may be replaced with each other to easily make a transportable breakroom box 1 that has an entrance 1*e* on a right side. That is to say, the entrance 1*e* may be arranged on an appropriate side depending on the installation location.

Further, even in temporary cases, such as watching sports outdoors in hot weather, and the like, places where spectators take a break are promptly secured, and the places where spectators take a break are promptly removed after the event. The transportable breakroom box is very useful for temporary installation. That is to say, the transportable breakroom box according to the present invention can be promptly installed at desired places, and contributes to promptly installing breakrooms and smoking rooms.

In addition, those who present with manifesting symptoms such as cough and fever and may be infected with the new coronavirus infection (COVID-19) will undergo polymerase chain reaction (PCR) testing. If the PCR test subject is tested in a building such as a hospital where the testing facility is located, there is a risk of spreading the infection. Therefore, by transporting the portable breakroom box of the present invention to the vicinity of the testing facility and undergoing the PCR test in the portable breakroom box, it is possible to contribute to the prevention of the spread of infection.

This portable breakroom box can also be used for testing not only for new coronavirus infections but also for other highly infectious viruses, thereby contributing to the prevention of infection.

REFERENCE SIGNS LIST

1 transportable breakroom box
1*a* floor beam
1*b* pillar
1*c* wallboard
1*c*1 wall sheet on a right side (first wall)
1*c*2 wall sheet on a left side (second wall)
1*d* shingle
1*e* entrance
1*f* insertion hole
1*g* opening
1*h* window frame
1*i* rope hook
2 filter unit
2*a* water storage tank
2*b* drain hose
3 UV filter
3*a* inlet-side water supply hose
4 water supply hose
5 exhaust blower
5*a* discharge duct
6*a* indoor unit
6*b* outdoor unit
7 ventilation fan
8 light
9 mounting trestle

The invention claimed is:

1. A transportable breakroom box comprising:

a box as a breakroom having a floor space equal to or less than ten square meters;

a sliding door as an entrance provided to the box;

a vaporization filter provided to an opening which is arranged in a first wall of the box;

a water storage tank that is provided at an outside of the first wall, and stores water that is to be supplied to the vaporization filter; and a water supply pump that supplies water stored in the water storage tank to the vaporization filter;

an exhaust blower arranged at a second wall that is opposite the first wall; and one or both of a hanging hook used for hanging, the hanging hook being provided on a shingle of the box, and a floor beam to which forks of a forklift truck can be hooked, wherein the exhaust blower sucks and discharges air in the box, and sucks outside air through the vaporization filter, and water supplied to the vaporization filter and dripped down from the vaporization filter is collected in the water storage tank.

2. The transportable breakroom box according to claim 1, wherein an air conditioner is installed at the box.

3. The transportable breakroom box according to claim 1, wherein a ventilation fan is installed at the box.

4. The transportable breakroom box according claim 1, wherein the shingle is painted with thermal insulation paint.

5. The transportable breakroom box according to claim 1, wherein water supplied to the vaporization filter is supplied through a sterilization device.

* * * * *